United States Patent [19]

Vonusa

[11] 4,082,016

[45] Apr. 4, 1978

[54] LID REMOVER

[76] Inventor: Joseph S. Vonusa, 47 Somersett Dr., Mystic, Conn. 06355

[21] Appl. No.: 786,450

[22] Filed: Apr. 11, 1977

[51] Int. Cl.[2] ..... B67B 7/22

[52] U.S. Cl. ..... 81/3.43

[58] Field of Search ..... 29/427; 81/3.43, 3.44, 81/3.4

[56] References Cited

U.S. PATENT DOCUMENTS

| | | | |
|---|---|---|---|
| 475,115 | 5/1892 | Inglesby et al. | 81/3.43 UX |
| 2,013,209 | 9/1935 | Hargreaves | 81/3.43 |
| 2,232,882 | 2/1941 | Martino | 81/3.43 |
| 2,320,599 | 6/1943 | Hickman | 81/3.43 |
| 2,387,651 | 10/1945 | Densten | 81/3.44 |
| 2,547,748 | 4/1951 | Freer | 81/3.43 |

FOREIGN PATENT DOCUMENTS

| | | | |
|---|---|---|---|
| 684,558 | 11/1939 | Germany | 81/3.43 |

*Primary Examiner*—Milton S. Mehr

[57] ABSTRACT

A method and apparatus for removing the lid of a container. A pair of operating members are pivotally joined and are movable between open and closed positions. The operating members include juxtaposed handle elements at one end and associated jaw elements at their other ends. A resilient strap fixed at one end to an operating member forms a loop in the region between the jaw elements adapted to encircle the lid. The free end of the strap is drawn between the open handle elements in a direction away from the lid and draws the lid firmly against the jaw elements. The handle elements are then pivoted into the closed position and the device is moved as a unit to unscrew the lid. A piece of rigid sheet material may be attached to one of the jaw elements to enable the lid to be readily positioned in the plane of the jaw elements. In another embodiment, the invention is of one-piece construction and includes a handle portion and a strap portion.

3 Claims, 6 Drawing Figures

LID REMOVER

BACKGROUND OF THE INVENTION

The present invention relates generally to an improved method and improved apparatus for removing a lid from a container.

The method and apparatus described herein relates to the loosening and removal of caps, lids and the like of the screw-on variety and including caps, lids and the like which are cammed into engagement with the upper rim of the can, bottle or other container following a minimal rotation of the lid. Throughout the instant disclosure, the term "lid" shall be understood to mean top, cap, or any other equivalent removable and reapplicable device for closing and sealing the top or end portion of a container.

DESCRIPTION OF THE PRIOR ART

There are a number of devices known to the prior art for loosening and removing lids from their associated containers. One popular device, in particular, has been in the form of a sheet of rubber or other resilient material having a high coefficient of friction. In use, the sheet envelops the top and sides of the lid. The operator's hand grips the lid thus covered with the sheet and rotates the lid to an open position. The sheet thus in effect imparts to the operator's hand a higher coefficient of friction than is available to the operator using his bare hand.

Additionally, there were previously devices of various constructions utilizing straps, cables, bands, and the like to encircle the lid of a container and mounted on a handle extending chord-like away from the rim of the lid. The handle served to receive the operator's hand and thus impart a greater moment arm or degree of leverage than was available by using the rubber sheet. These later devices often included mechanisms for drawing and holding the straps, cables, bands and the like in a snug relation to the outer peripheral surface of the lid. The handle was then moved by the operator in an arcuate direction in order to rotate the lid acting through the straps, cables, bands, and the like encircling the lid of the container. The present invention is an improvement over these prior devices.

On occasion, the prior devices presented serrated edges or other sharp surfaces to the outer peripheral surface of the container lid, thereby marring it or otherwise harming the lid for future use. In some other instances, the strap, cable, or band adapted to encircle the lid could only be secured in successive finite lengths instead of in infinitely adjustable lengths. This was a shortcoming in that only certain sizes of lids could be readily loosened and removed. In some other instances of the prior art, the bearing surface of the opener presented to the lid was sometimes an arc of constant curvature so that it would provide a continuous bearing surface for one size of lid only and not for a variety of sizes. In some instances, also, the known devices were complicated and expensive to manufacture, or otherwise difficult to apply to a lid for its removal.

SUMMARY OF THE INVENTION

The present invention relates to a method and apparatus for removing the lid of a container. A lid as contemplated by this disclosure may be of the screw-on variety or of numerous other variations including a simple friction fit between the lid and the container.

In any event, to this end, a pair of operating members are pivotally joined so as to be movable between open and closed positions. The operating members include juxtaposed handle elements at one end and associated jaw elements at their other ends. A resilient strap fixed at one end to one of the operating members forms a loop in the region between the jaw elements adapted to encircle the outer peripheral surface of the lid. The free end of the strap is drawn between the handle elements in a direction away from the lid so that it snugly engages the lid and draws it firmly against the jaw elements. The handle elements are then moved into the closed position by pivoting them together and the device is then rotated as a unit to loosen and remove the lid. A locating device, possibly in the form of a sheet of rigid material, may be attached to one of the jaw elements to enable the lid to be readily positioned in the plane of the jaw elements. In another embodiment of the invention, the device is of one-piece construction and includes a handle portion to be gripped by the operator and a strap portion to encircle the outer periphery of the lid and also to be gripped by the operator. Gripping these parts, the operator rotates them as a unit to loosen and remove the lid.

As disclosed herein, the invention is of simplified construction and therefore inexpensive to manufacture and maintain. Additionally, it is of substantially universal design in that it is applicable to most sizes and shapes of container lids. Furthermore, the invention is harmless to the outer surface of a lid and, by reason of its construction, provides a pair of stable points of contact resulting in greater ease of removal of the lid.

The present invention quickly and easily permits an operator to locate or position the container lid so that it lies in the plane of the jaws. As an added feature, the resilient strap doubles back along itself resulting in increased friction which aids in removal of the container lid.

Other and further advantages of the invention are obvious or will become apparent from the description which follows.

BRIEF DESCRIPTION OF THE DRAWING

In the drawing, wherein like numerals refer to like parts throughout.

DESCRIPTION OF THE PREFERRED EMBODIMENTS

Figure 1:
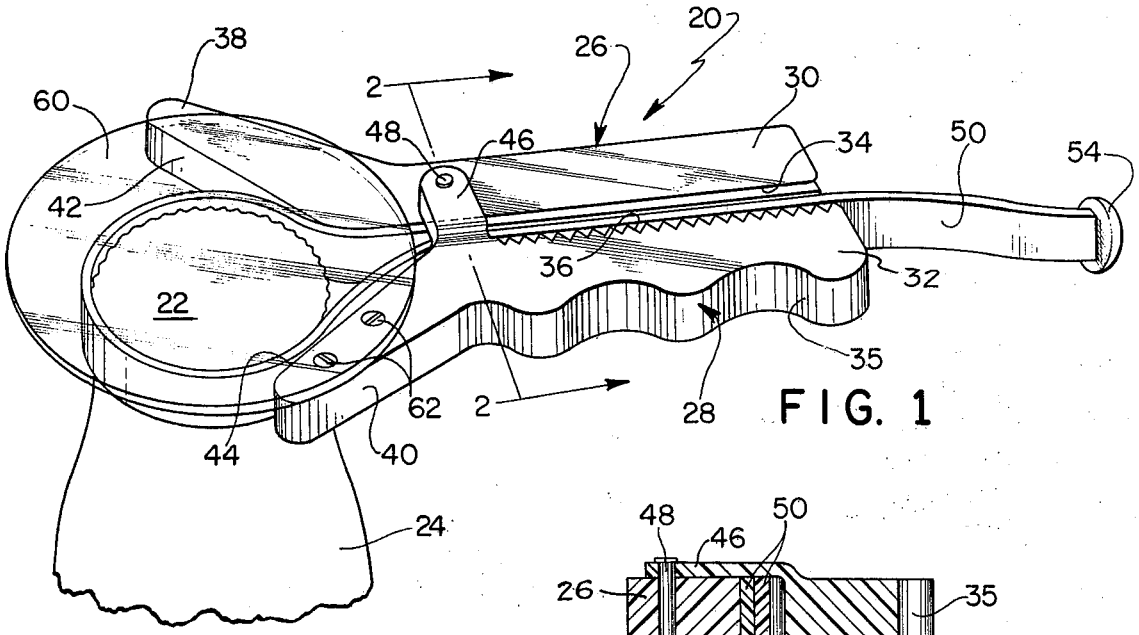
FIG. 1 is a perspective view illustrating the application of the invention to the lid of a container about to be loosened and removed.

Referring now to the drawings, and initially to FIG. 1, a lid remover generally indicated by the reference numeral 20, is illustrated as being applied to a lid 22 of a container 24.

In accordance with the invention, and as here embodied, first and second operating members, 26 and 28 respectively, each include juxtaposed handle elements 30 and 32 at one of their ends. The handle element 32 may have a knurled surface 35 for improving the grip of a user of the lid remover 20. In turn, these handle elements have first opposed surfaces, 34 and 36, respectively. At the other end of the handle elements 30 and 32 are a pair of associated jaw elements 38 and 40. The jaw elements 38 and 40 have second opposed surfaces, 42 and 44, respectively, which diverge in a direction away from the handle elements and from each other. The region generally defined by the surfaces 42 and 44 serves to receive the lid 22 for its loosening and removal from the container 24.

Figure 2:
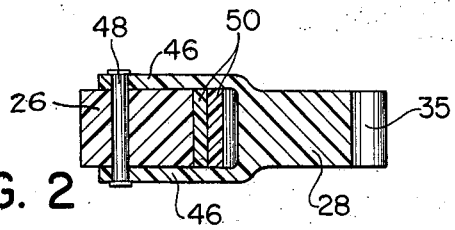
FIG. 2 is a detailed cross-section view taken along line 2—2 in FIG. 1.

In accordance with the invention, a pivot mechanism joining the first and second operating members is provided intermediate their ends permitting relative rotation of the operating members between an open position at which the handle elements are spaced apart and a closed position at which the handle elements are in a substantially contiguous relationship. As here embodied, and as seen most clearly in FIG. 2, the second operating member 28 is provided with an integral yoke 46 within which is received a portion of the handle element 26. A pin 48 pierces the handle element 26 and serves to join the handle element 26 to the yoke 46. In this manner, the operating members 26 and 28 are seen to be relatively rotatable between an open position as indicated in FIG. 3 and a closed position as indicated in FIG. 4.

In accordance with the invention and as here embodied, an elongated resilient element or strap 50 is fixed at one end to the operating member 26 in any suitable fashion such as by means of adhesive, glue, or staples. The strap 50 may extend the entire length of the handle 30 or it may be attached to the surface of the operating member 26 adjacent the opposed surface 42, this being strictly a matter of choice.

Figure 3:
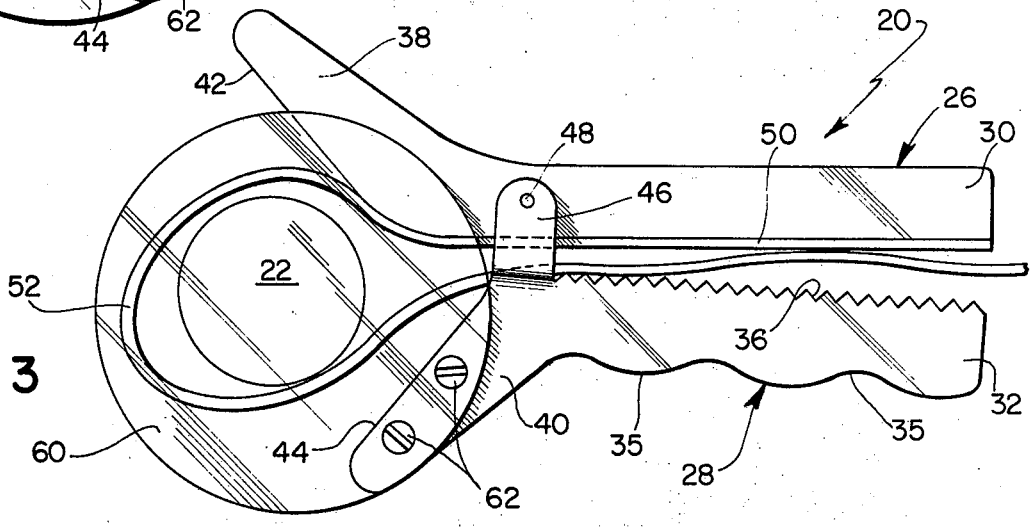
FIG. 3 is a top plan view of the invention in the open position and in the process of being applied to the lid as illustrated in FIG. 1.

In any event, as seen particularly in FIG. 3, the strap forms a loop in a region defined between the jaw elements 38 and 40 and its free end doubles back so that it extends again between the handle elements. As seen particularly well in FIG. 3, the loop 52 is adapted to encircle the outer peripheral surface of the lid 22. As the strap 50 is drawn in a direction away from the lid and between the handle elements 30 and 32 with the aid of a knob 54 formed at its free end, the loop is seen to engage the outer peripheral surface of the lid (see FIG. 4) and draws the lid firmly against the strap 50 proximate to the opposed surfaces 42 and 44.

Figure 4:
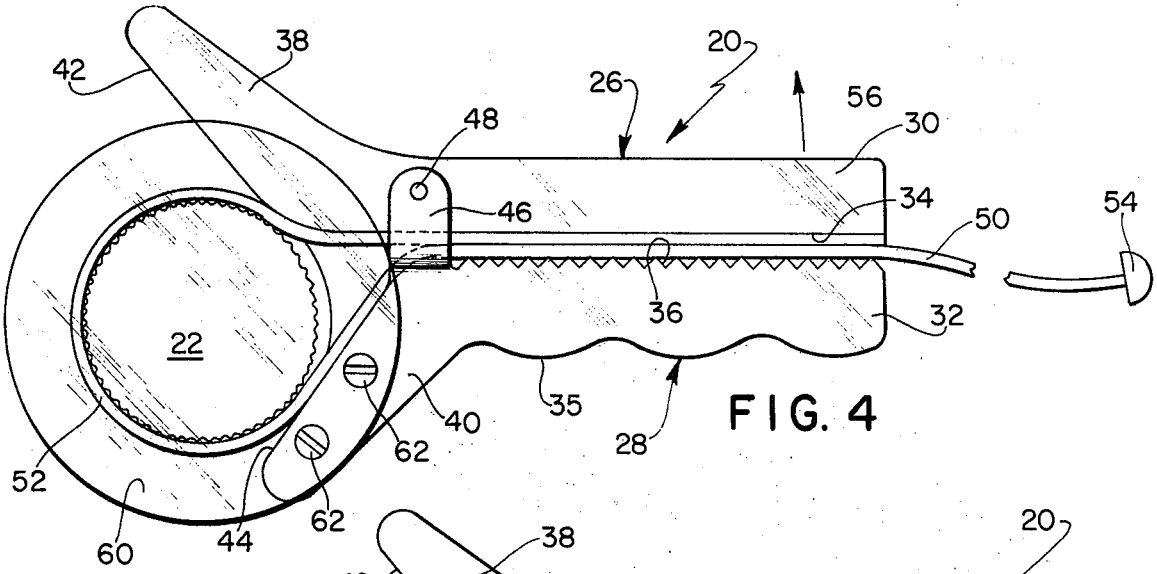
FIG. 4 is a top plan view of the invention in its closed position as it awaits rotation as a unit by the operator about an axis of the lid for the resulting loosening and removal of the lid from its container.

With the strap 50 drawn in a taut fashion so that the lid 22 is held firmly in proximate engagement with the surfaces 42 and 44, the handle elements 30 and 32 are pivoted on the pin 48 from the open position (see FIG. 3) to the closed position (see FIG. 4). The surface 36 of the handle element 32 may be serrated or roughened as illustrated in the drawings. This construction serves to improve the capability of the operator to grip tightly the strap 50 so that it remains in firm contact with the outer peripheral edge of the lid 22. Such a result is achieved when the handle elements 30 and 32 are pivoted to the closed position (FIG. 4) so that the raised portions of the surface 36 are impressed into the surface of the strap.

Thereupon, the operator rotates the lid remover 20 as a unit in the direction of an arrow 56 (FIG. 4) which is the normal counter-clockwise direction for removing lids of the screw-on variety. Such an operation results in loosening and removal of the lid from the container.

In accordance with the invention, a locating device is engageable with an upper surface of the lid 22 to aid in positioning the jaw elements 38 and 40 so that they lie in the plane of the lid. As here embodied, a plate 60 is illustrated as being fastened to the jaw element 40 by means of fasteners 62. The plate 60 is preferably of uniform thickness and may be fabricated from any suitable material such as metal or plastic. While the plate 60 is fastened or secured to the jaw element 40, it must be free of the jaw element 38 so as to permit rotation of the first operating member 26 relative to the second operating member 28. Furthermore, although the plate 60 is illustrated as being transparent for purposes of clarity in this description, it will be appreciated that the plate may be opaque and still retain its operative features.

In operation, then, utilizing the plate 60, the loop 52 of the strap 50 is enlarged as illustrated in FIG. 3. Thereupon, the container 24 is positioned so that the lid 22 is received within the loop 52. Further travel of the lid 22 in a direction toward a plane of the lid remover 20 results in its making contact with the plate 60. When this occurs, the lid 22 is known to be positioned in the plane of the jaw elements 38 and 40. At this point, it is only necessary to draw the free end of the strap 50 in a direction away from the region defined by the jaw elements 38 and 40 so that the strap snugly engages the outer peripheral rim of the lid 22 as seen in FIG. 4. Upon closure of the handle elements 30 and 32 and rotation of the lid remover 20 in the direction of the arrow 56, the lid 22 is loosened and subsequently removed.

Figure 5:
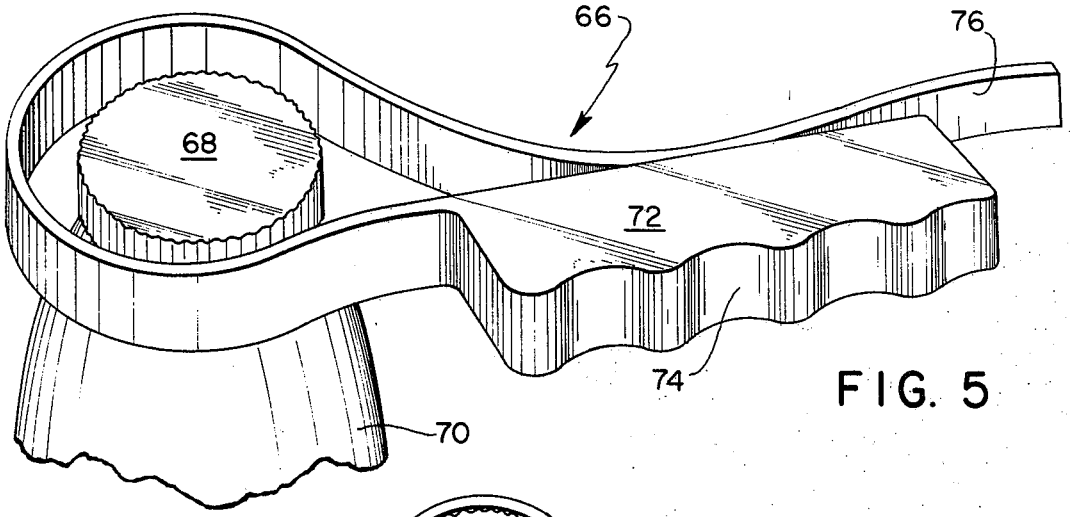
FIG. 5 is a perspective view of another embodiment of the invention as it is about to be applied to the lid of a container.
Figure 6:
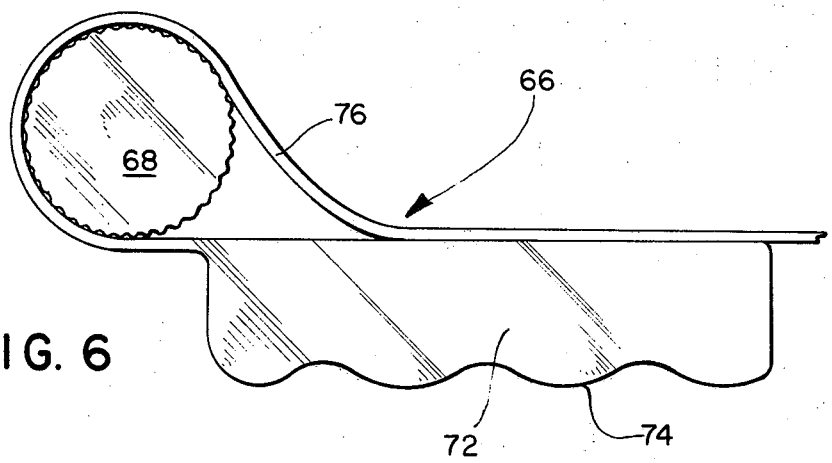
FIG. 6 is a top plan view of the embodiment illustrated in FIG. 5 in its closed position as it awaits rotation as a unit by the operator about an axis of the lid for the resulting loosening and removal of the lid from its container.

Another embodiment of the invention is illustrated in FIGS. 5 and 6. This embodiment is a simplified version of the lid remover 20 illustrated in FIGS. 1 through 4 and is of one-piece construction.

Specifically, a lid remover 66 is generally illustrated for the purpose of removing a lid 68 from a container 70. As here embodied, the lid remover includes a handle element 72 which may have a knurled portion 74 for improving the grip of an operator's hand and an elongated strap element 76 integral with the handle element 72 and extending from one end of the handle element.

In use, the lid remover 66 is applied to the lid 68 by looping the strap element 76 about the outer peripheral surface of the lid. The free end of the strap element 76 is drawn tightly about the outer peripheral surface of the lid 68 until it assumes the condition illustrated in FIG. 6. In this condition, the free end of the strap is positioned in contact with the handle element 72 such that the handle element and the free end of the strap are gripped together by the hand of the operator. Thereupon, the operator rotates the lid remover 66 as a unit about the longitudinal axis of the container 70 to thereby loosen and eventually remove the lid from the container.

The invention, in its broader aspects, is not limited to the specific details shown and described, and departures may be made from such details without departing from the principles of the invention, and without sacrificing its chief advantages.

What is claimed is:

1. Apparatus for removing from a container a lid having an axis of rotation comprising:

first and second operating members each including juxtaposed handle elements at one end thereof having first opposed surfaces and associated jaw elements at the other end thereof having second opposed surfaces generally diverging in a direction away from said handle elements;

pivot means joining said first and second operating members intermediate their ends permitting relative rotation thereof between an open position at which said handle elements are spaced apart and a closed position at which said handle elements are in a substantially contiguous relationship;

a substantially flat rigid plate fixed to one of said operating members and lying in a plane parallel to and proximate with a plane containing said jaw elements, said plate being engageable with an upper surface of the lid to be removed for positioning said jaw elements so that they lie in the plane of the lid; and an elongated resilient element fixed at one end to one of said operating members and forming a loop in a region defined between said jaw elements and having a free end extending between said handle elements, said loop adapted to encircle the outer peripheral surface of the lid, such that as the free end of said resilient element is drawn between said handle elements in a direction away from the container lid, the loop engages the outer peripheral surface of the container lid and draws the lid firmly against said resilient element proximate to said opposed surfaces whereby relative rotary displacement of said handle elements from said open position to said closed position draws said first opposed surfaces into engagement with said element and subsequent rotation of said handle elements as a unit in a direction about the axis of rotation of the container lid results in loosening and removal of the lid from the container.

2. Apparatus as set forth in claim 1 wherein at least one of said first opposed surfaces is roughened so as to tightly grip said resilient element when said handle elements are in the closed position.

3. The method of removing the removable lid of a container having a longitudinal axis comprising the steps of:

providing a pair of operating members each including juxtaposed handle elements at one end thereof and associated jaw elements at the other end thereof having opposed surfaces generally diverging in a direction away from the handle elements;

providing an elongated resilient element fixed at one end to one of the operating members;

forming a loop with the resilient element;

locating the lid in the plane of the opposed surfaces of the jaw elements;

inserting the lid of the container within the loop so that the loop encircles the outer peripheral surface of the lid;

drawing the free end of the resilient element between the handle elements in a direction away from the loop until the loop snugly engages the lid;

continuing to draw the free end of the resilient element until the lid is positioned tangentially to the opposed surfaces of the jaw elements;

moving the handle elements into substantially contiguous relationship;

holding the resilient element between the handle elements; and rotating the operating members as a unit about an axis of the lid so that the lid is loosened and removed from the container.

* * * * *